US008955837B2

(12) United States Patent
Yin et al.

(10) Patent No.: US 8,955,837 B2
(45) Date of Patent: Feb. 17, 2015

(54) CONTROL METHOD AND CONTROL SYSTEM BASED ON SINGLE-POWER CACHING MECHANISM

(71) Applicant: GRG Banking Equipment Co., Ltd., Guangzhou, Guangdong (KR)

(72) Inventors: Fazhi Yin, Guangzhou (KR); Guoyou Liang, Guangzhou (KR); Yanwen Ha, Guangzhou (KR)

(73) Assignee: GRG Banking Equipment Co., Ltd., Guangzhou, Guangdong (KR)

( * ) Notice: Subject to any disclaimer, the term of this patent is extended or adjusted under 35 U.S.C. 154(b) by 0 days.

(21) Appl. No.: 14/352,309

(22) PCT Filed: Mar. 26, 2013

(86) PCT No.: PCT/CN2013/073168

§ 371 (c)(1),
(2) Date: Apr. 16, 2014

(87) PCT Pub. No.: WO2013/174176

PCT Pub. Date: Nov. 28, 2013

(65) Prior Publication Data

US 2014/0239586 A1 Aug. 28, 2014

(30) Foreign Application Priority Data

May 25, 2012 (CN) ..... 2012 1 0168762

(51) Int. Cl.

| | |
|---|---|
| ***B65H 29/66*** | (2006.01) |
| ***B65H 39/14*** | (2006.01) |
| ***G07D 11/00*** | (2006.01) |
| ***B65H 29/00*** | (2006.01) |
| ***B65H 5/06*** | (2006.01) |

(52) U.S. Cl.

CPC ..... *G07D 11/0021* (2013.01); *B65H 29/006* (2013.01); *B65H 5/06* (2013.01); *B65H 2301/41912* (2013.01); *B65H 2403/946* (2013.01); *B65H 2701/1912* (2013.01)

USPC ..... 271/216; 242/528

(58) Field of Classification Search

CPC .... B65H 23/063; B65H 23/066; B65H 31/28; B65H 39/14; G07D 11/0021

USPC ..... 271/216; 242/528

See application file for complete search history.

(56) References Cited

U.S. PATENT DOCUMENTS

2004/0173708 A1 * 9/2004 Neumann et al. ..... 242/412.3

FOREIGN PATENT DOCUMENTS

CN 2388653 Y 7/2000
CN 101734508 A 6/2010

(Continued)

OTHER PUBLICATIONS

International Search Report dated Jul. 4, 2013 from corresponding International Application No. PCT/CN2013/073168.

*Primary Examiner* — David H Bollinger

(74) *Attorney, Agent, or Firm* — Wolf, Greenfield & Sacks, P.C.

(57) ABSTRACT

A control method based on a single-power caching mechanism. The single-power caching mechanism comprises an active coiling block, a driving motor, passive coiling blocks, and a tape coiling. The active coiling block is disposed on the driving motor. The active roiling block and the passive coiling blocks are connected through the tape coiling. The control method comprises the following steps: 1) when the driving motor needs to be shut down, detecting a rotational inertia of the active coiling block, a semidiameter of the active coiling block, a semidiameter of the passive coiling blocks, and a rotational inertia of the passive coiling blocks; and 2) controlling a breaking torque of the driving motor to be $M_1 \leq I_1 \times r \times M_2/(I_2 \times R)$, $M_2$ being a torsional moment of the passive coiling blocks. Also disclosed is a control system based on a single-power caching mechanism. When the breaking torque $M_1$ of the driving motor is controlled to be smaller than or equal to $I_1 \times r \times M_2/(I_2 \times R)$, it can be ensured that the active coiling block and the passive coiling blocks remain a same operation state in a process of reducing the speed until they are static completely, rotational distances are equal and the tape coiling is straightened.

4 Claims, 2 Drawing Sheets

(56) References Cited

FOREIGN PATENT DOCUMENTS

| | | | |
|---|---|---|---|
| CN | 1991919 | A | 8/2010 |
| CN | 102044109 | A | 5/2011 |
| CN | 102066220 | A | 5/2011 |
| CN | 102066222 | A | 5/2011 |
| CN | 102160095 | A | 8/2011 |
| CN | 102700965 | A | 10/2012 |
| EP | 0881177 | A | 12/1998 |
| JP | 0867382 | A | 3/1996 |

* cited by examiner

CONTROL METHOD AND CONTROL SYSTEM BASED ON SINGLE-POWER CACHING MECHANISM

This application is the national phase of International Application No. PCT/CN2013/073168, filed on Mar. 26, 2013, which claims the priority of Chinese Patent Application No. 201210168762.3 titled "METHOD AND SYSTEM FOR CONTROLLING CACHING MECHANISM BASED ON SINGLE-POWER", filed with the Chinese State Intellectual Property Office on May 25, 2012, which applications are incorporated herein by reference to the maximum extend allowable by law.

FIELD OF THE INVENTION

The present application relates to the technical field of medium caching mechanism, and particularly to a method and a system for controlling a caching mechanism based on single-power.

BACKGROUND OF THE INVENTION

An existing medium caching mechanism mainly employs a dual-power or single-power drive mode, especially the single-power drive mode, and is generally composed of one drive roll and two driven rolls, or is composed of one drive roll and one driven roll.

As shown in FIG. 1, taking one drive roll 11 and two driven rolls as an example, in the existing medium caching mechanism, a driving motor 10 is fixedly mounted on a side plate 9 thereof, a first rotary shaft 13 and a second rotary shaft 12 are rotatably mounted on the side plate 9 through a second one-way bearing 15. The driving motor 10 is mounted on a b-side of the side plate 9 (for convenience of description and distinguish, the two sides of the side plate 9 are defined as a-side and b-side), a shaft of the driving motor has extension portions on both the a-side and b-side of the side plate 9. The drive roll 11 is sleeved outside the driving motor 10 and is fixedly mounted on one end of the rotating shaft of the driving motor; at the a-side of the side plate 9, a third synchronous pulley 1 is fixedly mounted on the other end of the rotating shaft of the driving motor, rotation of the driving motor 10 can directly drive the drive roll 11 and the third synchronous pulley 1 to rotate.

A first synchronous pulley 5 and a second synchronous pulley 7 are rotatably mounted to the first rotary shaft 13 and the second rotary shaft 12 respectively through a first one-way bearing 6. The three synchronous pulleys are connected with each other by a synchronous belt 3, so that the rotation pace and rotation direction thereof are consistent, the operating forces of the first one-way bearing 6 and the second one-way bearing 15 have opposite directions.

A first driven roll 4 and a second driven roll 8 are rotatably mounted on the first rotary shaft 13 and the second rotary shaft 12 respectively through a torque limiter 14, under the action of the torque limiter 14, when there is a relative rotation or a trend of relative rotation between the driven roll and the rotary shaft corresponding to it, there will exist a torque which is not larger than a set value of the torque limiter 14, this torque can prevent the driven roll from rotating or drive the driven roll to rotate. The two driven rolls are respectively windingly fitted with a tape 2 of a proper length, the other ends of the tapes 2 are both disposed on the drive roll 11.

During feeding of banknotes, when the driving motor 10 drives the third synchronous pulley 1 and the drive roll 11 to rotate forwardly, the first one-way bearing 6 slides idly, the first synchronous pulley 5 and the second synchronous pulley 7 have no effect on the first rotary shaft 13 and the second rotary shaft 12, and the second one-way bearing 15 performs lock-rotation, the first rotary shaft 13 and the second rotary shaft 12 generate a torque preventing the first driven roll 4 and the second driven roll 8 from rotating through the torque limiter 14, the drive roll 11 pulls the first driven roll 4 and the second driven roll 8 to rotate forwardly through the tapes 2 by overcoming the torque of the torque limiter 14. At this time, the linear speeds of the drive roll 11, the tape 2 and the driven rolls are maintained consistent.

Generally, during withdrawing of banknotes, the tape 2 is definitely wounded on the drive roll 11, when the driving motor 10 drives the third synchronous pulley 1 and the drive roll 11 to rotate reversely, the drive roll 11 releases the tape 2, the third synchronous pulley 1 drive the first synchronous pulley 5 and the second synchronous pulley 7 to rotate reversely by large transmission ratio, the second one-way bearing 15 rotates idly, the side plate 9 has no effect on the first rotary shaft 13 and the second rotary shaft 12, and the first one-way bearing 6 performs lock-rotation, the first synchronous pulley 5 and the second synchronous pulley 7 have effects on the first rotary shaft 13 and the second rotary shaft 12, thereby driving the first rotary shaft 13 and the second rotary shaft 12 to rotate reversely, the first rotary shaft 13 and the second rotary shaft 12 drive the first driven roll 4 and the second driven roll 8 to rotate reversely through the torque limiter 14 in a way that the first rotary shaft 13 and the second rotary shaft 12 slide with respect to the first driven roll 4 and the second driven roll 8 and thereby generating a constant torque, the first driven roll 4 and the second driven roll 8 rotate reversely and thereby tightening the tape 2 released by the drive roll 11. At this time, the linear speeds of the drive roll 11, the tape 2 and the driven rolls are maintained consistent.

In a control principle of the above mechanism, during feeding of banknotes, once the drive motor 10 stops rotating rapidly, the drive roll 11 will be affected by the brake torque of the driving motor 10, and is stopped by rapidly decelerating; a driven roll rotates with a speed that is decelerated till it stops due to a torque provided by the torque limiter 14 in a direction opposite to the motion direction. During the time within which the drive roll 11 is stopped, the rotating distance of the driven roll is larger than the rotating distance of the drive roll 11, resulting that the tape 2 can not be tensioned, and thereby affecting the next banknotes feeding.

There is an urgent demand for the person skilled in the art to solve the technical problem that during banknotes feeding, how to ensure that the tape still can remains in a tensioned state after the driving motor stops rotating.

SUMMARY OF THE INVENTION

In view of this, it is provided according to the present application a method and a system for controlling caching mechanism based on single-power, to ensure that during banknotes feeding, the tape is ensured to still remain in a tensioned state after the driving motor stops rotating.

To achieve the above object, it is provided according to the present application the following technical solutions.

A method for controlling a caching mechanism based on single-power, the caching mechanism based on single-power including a drive roll, a driving motor, a driven roll and a tape, with the drive roll being disposed on the driving motor, and the drive roll and the driven roll being connected with each other through the tape, wherein the method includes:

1) detecting the moment of inertia $I_1$ of the drive roll, the radius R of the drive roll, the radius r of the driven roll and the moment of inertia $I_2$ of the driven roll when the driving motor is needed to be stopped;

2) controlling a brake torque $M_1$ of the driving motor to be $M_1 \leq I_1 \times r \times M_2/(I_2 \times R)$, in which $M_2$ is the torque moment of the driven roll.

Preferably, in the above method for controlling the caching mechanism based on single-power, the step 1) specifically includes: detecting in real time the radius R of the drive roll, and the radius r of the driven roll after a stop instruction for the driving motor is sent out, and calculating the moment of inertia $I_1$ of the drive roll and the moment of inertia $I_2$ of the driven roll respectively.

A system for controlling a caching mechanism based on single-power, the caching mechanism based on single-power including a drive roll, a driving motor, a driven roll and a tape, with the drive roll being disposed on the driving motor, and the drive roll and the driven roll being connected with each other through the tape, wherein the system includes:

a processing device configured to detect the moment of inertia $I_1$ of the drive roll, the radius R of the drive roll, the radius r of the driven roll and the moment of inertia $I_2$ of the driven roll when the driving motor is needed to be stopped; and a controller configured to control a brake torque $M_1$ of the driving motor as $M_1 \leq I_1 \times r \times M_2/(I_2 \times R)$, in which $M_2$ is the torque moment of the driven roll.

Preferably, in the above system for controlling the caching mechanism based on single-power, the processing device includes:

a radius detecting device configured to detect in real time the radius R of the drive roll and the radius r of the driven roll;

a processing unit configured to output the moment of inertia $I_1$ of the drive roll on the basis of the detected mass $m_1$ of the drive roll and radius R of the drive roll and outputs the moment of inertia $I_2$ of the driven roll on the basis of the detected mass $m_2$ of the driven roll and radius r of the driven roll.

As can be seen from the above technical solutions, the method for controlling the caching mechanism based on single-power according to the present application increases the rotating distance and operating time of the drive roll, so that the rotating distance of the drive roll when it is stopped is equal to the rotating distance of the driven roll, thereby achieving the purpose of tap tension. When controlling the brake torque $M_1$ of the driving motor to be less than or equal to $I_1 \times r \times M_2/(I_2 \times R)$ according to the present application, it is ensured that the drive roll and the driven roll maintain the same operating state all the time during the decelerating process till it is completely static, thereby achieving that the rotating distances of the drive roll and the driven roll are equal to each other and the tape is tensioned.

BRIEF DESCRIPTION OF THE DRAWINGS

In order to clearly illustrate embodiments of the present application or technical solutions in the prior art, drawings used in the descriptions of the embodiments or the prior art will be described briefly hereinafter. Apparently, the drawings in the following description are only some embodiments of the present application, and those skilled in the art can also obtain other drawings based on these drawings without any creative work.

DETAILED DESCRIPTION OF THE INVENTION

It is disclosed according to the present application a method and a system for controlling caching mechanism based on single-power, to ensure that during banknote feeding, the tape still can remains in a tensioned state after the driving motor stops rotating.

Technical solutions in the embodiments of the present application will be described clearly and completely hereinafter in conjunction with the accompanying drawings in the embodiments of the present application. Apparently, the embodiments described hereinafter are only a part of the embodiments of the present application, rather than all of the embodiments. All other embodiments obtained by those skilled in the art, based on the embodiments in the present application, without any creative work should be considered as falling into the protection scope of the present application.

Figure 1:
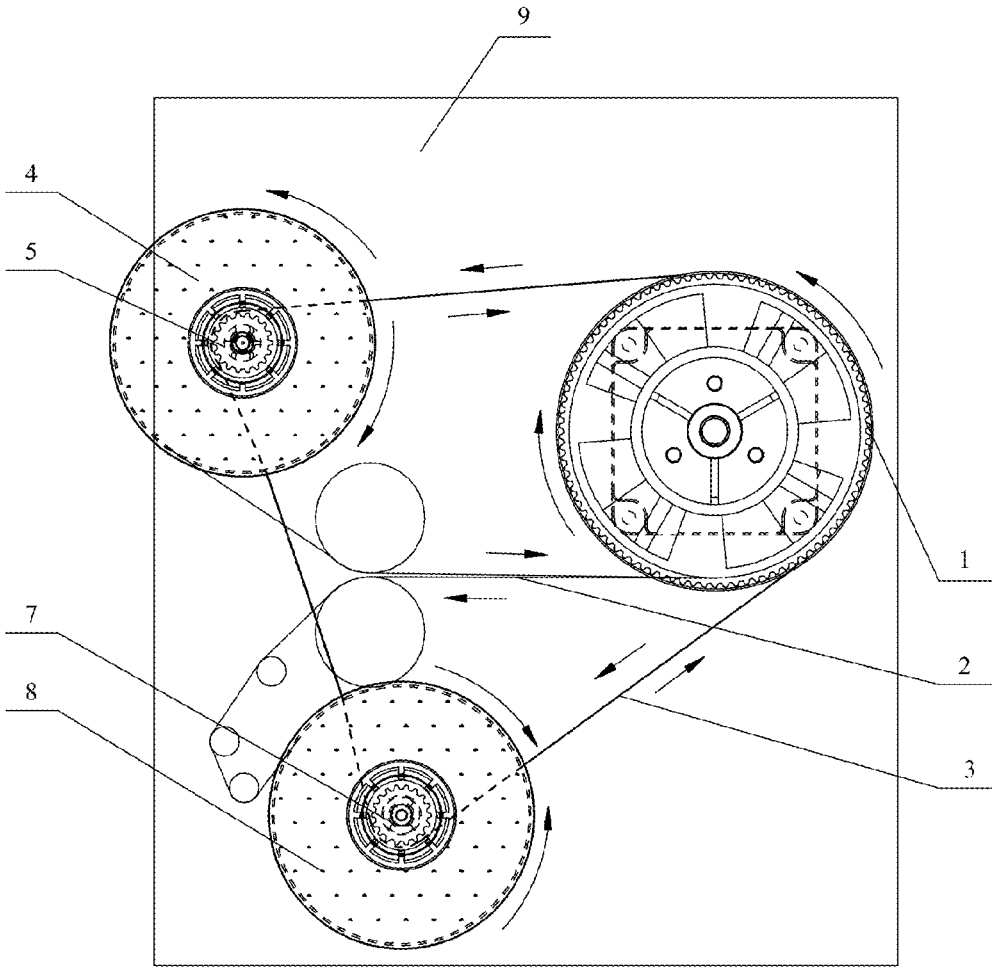
FIG. 1 is a front view of caching mechanism based on single-power.
Figure 2:
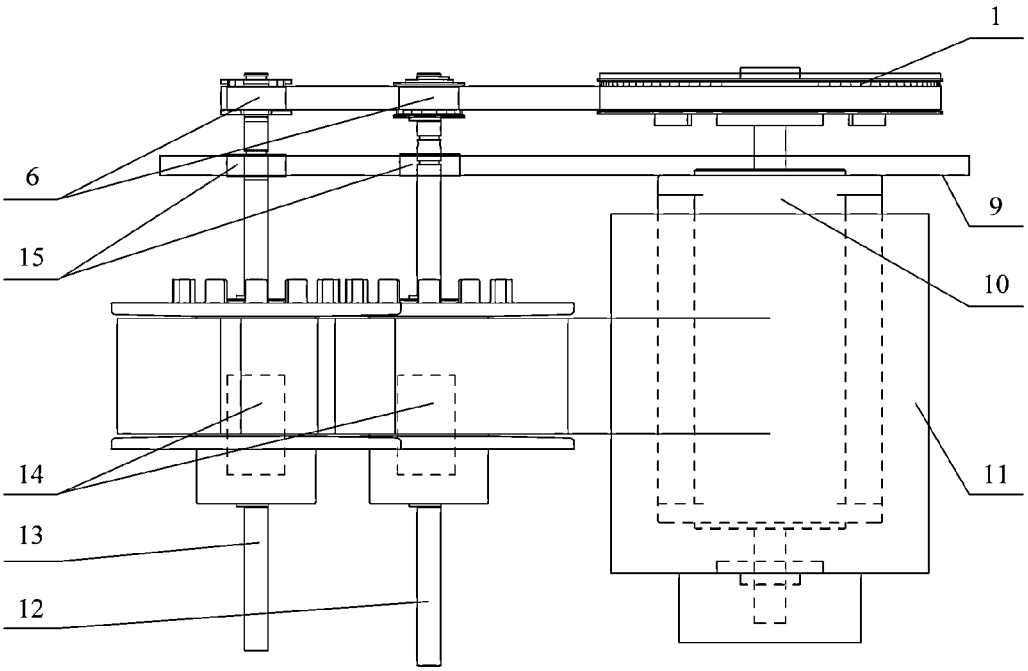
FIG. 2 is a top view of the caching mechanism based on single-power.
Figure 3:
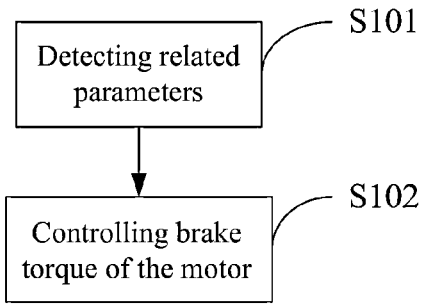
FIG. 3 is a flow diagram of a method for controlling a caching mechanism based on single-power according to an embodiment of the present application.

Referring to FIG. 3, which is a flow diagram of a method for controlling a caching mechanism based on single-power according to an embodiment of the present application.

The caching mechanism based on single-power is the same as the caching mechanism disclosed in the background, and includes a drive roll, a driving motor, a driven roll and a tape, the drive roll is disposed on the driving motor, the drive roll and the driven roll are connected with each other through the tape.

The method for controlling the caching mechanism based on single-power according to the embodiment of the present application includes:

step S101: detecting related parameters;

detecting the moment of inertia $I_1$ of the drive roll, the radius R of the drive roll, the radius r of the driven roll and the moment of inertia $I_2$ of the driven roll when the driving motor is needed to be stopped.

step S102: controlling brake torque of the motor;

controlling a brake torque $M_1$ of the driving motor to be $M_1 \leq I_1 \times r \times M_2/(I_2 \times R)$, in which $M_2$ is the torque moment of the driven roll. The torque moment $M_2$ of the driven roll is provided by a torque limiter, and after the torque limiter of the driven roll is determined, the $M_2$ is a constant value.

Because the moment of inertia $I_1$ of the drive roll is related to the mass and radius of the drive roll, the moment of inertia $I_2$ of the driven roll is related to the mass and radius of the driven roll, and the mass of the drive roll and the mass of the driven roll are constant values, as long as the radius R of the drive roll and the radius r of the driven roll are detected, the moment of inertia $I_1$ of the drive roll and the moment of inertia $I_2$ of the driven roll can be obtained.

Therefore, the step S101 may include:

detecting in real time the radius R of the drive roll, and the radius r of the driven roll after a stop instruction for the driving motor is sent out, and calculating the moment of inertia $I_1$ of the drive roll and the moment of inertia $I_2$ of the driven roll respectively.

The following describes the derivation of the formula $M_1 \leq I_1 \times r \times M_2/(I_2 \times R)$ and the core idea of the present application.

During the time within which the driving motor is stopped, let us define that the rotating distance of the drive roll is $L_1$, the rotating distance of the driven roll is $L_2$, the stop time of the driving motor is $t_1$, the stop time of the driven roll is $t_2$, the operation speed of the tape is v, the moment of inertia of the drive roll is $I_1$ ($I=\Sigma m_i \times r_i^2$), the brake moment of the driving motor is $M_1$, the moment of inertia of the driven roll is $I_2$ ($I=\Sigma m_i \times r_i^2$), the torque which the torque limiter provides to the driven roll is $M_2$. The radius of the drive roll is R, the radius of the driven roll is r, the initial angular velocity when the drive roll stops operating is $\omega_1$, the angular acceleration during stopping process is $\Delta\omega_1$, the initial angular velocity when the driven roll stops operating is $\Delta\omega_2$, the angular acceleration during stopping process is $\Delta\omega_2$, so it can be obtained that:

$$\omega_1 = v/R \quad (1);$$

$$\omega_2 = v/r \quad (2);$$

the angular acceleration during decelerating the drive roll to stop it is:

$$\Delta\omega_1 = M_1/I_1 \quad (3);$$

the angular acceleration during decelerating the drive roll being decelerated to stop it is:

$$\Delta\omega_2 = M_2/I_2 \quad (4);$$

it can be derived from the formulas (1), (2), (3), (4) that:

the stop time of the driving motor is:

$$t_1 = \omega_1/\Delta\omega_1 = v \times I_1/(R \times M_1) \quad (5)$$

the stop time of the driven roll is:

$$t_2 = \omega_2/\Delta\omega_2 = v \times I_2/(r \times M_2) \quad (6)$$

it can be derived from the formulas (5), (6) that:

Ideally, both the drive roll and the driven roll move with an uniform deceleration, the rotating distance of the drive roll is:

$$L_1 = \tfrac{1}{2} \times v \times t_1 = \tfrac{1}{2} \times v \times v \times I_1/(R \times M_1); \quad (7);$$

the rotating distance of the driven roll is:

$$L_2 = \tfrac{1}{2} \times v \times t_2 = \tfrac{1}{2} \times v \times v \times I_2/(r \times M_2); \quad (8);$$

According to the above conclusions, when $L_2 > L_1$, the tape can not be tightened. In order to ensure that the tape is tensioned, $L_1$ is at least equal to $L_2$, the following formula can be derived form the formulas (7), (8):

$$\Delta L = \tfrac{1}{2} \times v^2 \times [I_2/(r \times M_2) - I_1/(R \times M_1)] \quad (9)$$

That is, when $\Delta L=0$, the tape is tensioned. Without changing the characteristics of the roll itself, the tape can be tightened by increasing $M_2$ or reducing $M_1$. However, in practical applications, increasing $M_2$ will result in an increased mechanical load during banknote feeding, thereby indirectly forcing the torque provided by the motor to increase. The brake torque $M_1$ will also increase at the same time. Reduction in $M_1$ is limited because the driving motor itself is required to provide certain torque, and change of the brake torque $M_1$ is not prominent.

From a micro perspective, for a stop by deceleration process, in each interval in which the motor pulse jumps, as long as the instant brake torque $dM_1$ is reduced to a sufficiently small value, the operating time of the drive roll will be increased, and $L_1$ is increased; under the action of the torque limiter, the driven roll reduces the speed thereof to be equal to that of the drive roll, thereby maintaining the same moving state as the drive roll.

According to formula (9), $I_2/(r \times M_2)$ will be less than or equal to $I_1/(R \times dM_1)$. That is, the instant rotating distance of the driven roll is less than or equal to the instant rotating distance of the drive roll. From a macro perspective, that is, the operating time for stopping the drive roll is increased, thereby causing the rotating distance for stopping of the drive roll is equal to the rotating distance of the driven roll, and achieving the tension of the tape eventually.

Further, in each deceleration interval of the drive roll, because the same operating state is maintained eventually, the rotating distance of the drive roll during the decelerating process is $dL_1 = \tfrac{1}{2} \times (v_{i-1}^2 - v_i^2) \times I_1/(R_i \times dM_1)$, and the rotating distance of the driven roll during the decelerating process is $dL_2 = \tfrac{1}{2} \times (v_{i-1}^2 - v_i^2) \times I_2/(r_i \times M_2)$, so it can be obtained in each deceleration interval:

$$\Delta dL = \tfrac{1}{2} \times (v_{i-1}^2 - v_i^2) \times [I_2/(r_i \times M_2) - I_1/(R_i \times dM_1)] \quad (10)$$

For formula (10), in each deceleration interval, $R_i$ and $r_i$ are determined, $I_1$ and $I_2$ under the radius $R_i$ and $r_i$ are also determined, in turn $[I_2/(r_i \times M_2) - I_1/(R_i \times dM_1)]$ is a determined value, and is a value less than or equal to 0. When $[I_2/(r_i \times M_2) - I_1/(R_i \times dM_1)]$ is equal to 0, it is illustrated that in the current interval, the driven roll is decelerated with the same decelerating acceleration, thereby maintaining the same operating state all the time, so the tape will not be relaxed; when $[I_2/(r_i \times M_2) - I_1/(R_i \times dM_1)]$ is less than 0, the deceleration time of the drive roll is longer than the deceleration time of the driven roll, that is, the drive roll maintains a trend all the time that it rotates at a speed faster than the driven roll, so the tape will not be relaxed as well. Eventually, we can believe that in each deceleration interval of the drive roll, as long as $dM_1$ is small enough, then the $\Delta dL$ is equal to 0, and the tape can be tensioned.

From a macro perspective, when $[I_2/(r \times M_2) - I_1/(R \times M_1)] \leq 0$, that is $M_1 \leq I_1 \times r \times M_2/(I_2 \times R)$ is a threshold, in a case that the deceleration brake torque of the drive roll is maintained less than this threshold all the time, it can be ensured that the drive roll and the driven roll maintain the same operating state all the time during the decelerating process till they are completely static, thereby achieving that the rotating distances of the drive roll and the driven roll are equal to each other and the tape can be tensioned.

A system for controlling a caching mechanism based on single-power, the caching mechanism based on single-power including a drive roll, a driving motor, a driven roll and a tape, with the drive roll being disposed on the driving motor, and the drive roll and the driven roll being connected with each other through the tape, wherein the system includes a processing device and a controller.

Specifically, the processing device is used to detect the moment of inertia $I_1$ of the drive roll, the radius R of the drive roll, the radius r of the driven roll and the moment of inertia $I_2$ of the driven roll when the driving motor is needed to be stopped, and the controller is used to control a brake torque $M_1$ of the driving motor as $M_1 \leq I_1 \times r \times M_2/(I_2 \times R)$, in which $M_2$ is the torque moment of the driven roll.

The system for controlling the caching mechanism based on single-power according to the embodiment of the present application employs the same principle with the method for controlling the caching mechanism based on single-power disclosed in the above embodiment to adjust the tape relaxation phenomenon, the system has the same technical effect with the method, referring to the method for controlling the caching mechanism based on single-power disclosed in the above embodiment specifically, which will not be described in detailed herein.

Because the moment of inertia $I_1$ of the drive roll is related to the mass and radius of the drive roll, the moment of inertia $I_2$ of the driven roll is related to the mass and radius of the driven roll, and the mass of the drive roll and the mass of the driven roll are constant values, as long as the radius R of the drive roll and the radius r of the driven roll are detected, the moment of inertia $I_1$ of the drive roll and the moment of inertia $I_2$ of the driven roll can be obtained.

Therefore, the processing device disclosed by the embodiment of the present application includes a radius detecting device and a processing unit.

Specifically, the radius detecting device is used to detect in real time the radius R of the drive roll and the radius r of the driven roll, and the processing unit is used to output the moment of inertia $I_1$ of the drive roll on the basis of the detected mass $m_1$ of the drive roll and radius R of the drive roll and outputs the moment of inertia $I_2$ of the driven roll on the basis of the detected mass $m_2$ of the driven roll and radius r of the driven roll.

The embodiments of the present invention are described herein in a progressive manner, with the emphasis for each embodiment is placed on describing the difference between the embodiment and the other embodiments; hence, the same or similar parts among the individual embodiments can be referred to from each other.

Those skilled in the art can achieve or implement the present application based on the above descriptions of the embodiments herein, and it is apparent that those skilled in the art may make various modifications to the embodiments. The general principle defined herein can be implemented in other embodiments without departing from the spirit or scope of the present application. Therefore, the present application will not be limited to the embodiments described herein, but to be in accordance with the widest scope consistent with the principle and novel features disclosed herein.

The invention claimed is:

1. A method for controlling a caching mechanism based on single-power, wherein the caching mechanism based on single-power comprising a drive roll, a driving motor, a driven roll and a tape, with the drive roll being disposed on the driving motor, and the drive roll and the driven roll being connected with each other through the tape, wherein the method comprises:

1) detecting the moment of inertia $I_1$ of the drive roll, the radius R of the drive roll, the radius r of the driven roll and the moment of inertia $I_2$ of the driven roll when the driving motor is needed to be stopped;

2) controlling a brake torque $M_1$ of the driving motor to be $M_1 \leq I_1 \times r \times M_2/(I_2 \times R)$, wherein $M_2$ is the torque moment of the driven roll.

2. The method for controlling a caching mechanism based on single-power according to claim 1, wherein the step 1) comprises: detecting in real time the radius R of the drive roll, and the radius r of the driven roll after a stop instruction for the driving motor is sent out, and calculating the moment of inertia $I_1$ of the drive roll and the moment of inertia $I_2$ of the driven roll respectively.

3. A system for controlling a caching mechanism based on single-power, the caching mechanism based on single-power comprising a drive roll, a driving motor, a driven roll and a tape, with the drive roll being disposed on the driving motor, and the drive roll and the driven roll being connected with each other through the tape, wherein the system comprises:

a processing device configured to detect the moment of inertia $I_1$ of the drive roll, the radius R of the drive roll, the radius r of the driven roll and the moment of inertia $I_2$ of the driven roll when the driving motor is needed to be stopped; and a controller configured to control a brake torque $M_1$ of the driving motor to be $M_1 \leq I_1 \times r \times M_2/(I_2 \times R)$, wherein $M_2$ is the torque moment of the driven roll.

4. The system for controlling a caching mechanism based on single-power according to claim 3, wherein the processing device comprises:

a radius detecting device configured to detect in real time the radius R of the drive roll and the radius r of the driven roll;

a processing unit configured to output the moment of inertia $I_1$ of the drive roll on the basis of the detected mass $m_1$ of the drive roll and radius R of the drive roll and outputs the moment of inertia $I_2$ of the driven roll on the basis of the detected mass $m_2$ of the driven roll and radius r of the driven roll.

* * * * *